US012735233B2

(12) United States Patent
Yao

(10) Patent No.: US 12,735,233 B2
(45) Date of Patent: Sep. 15, 2026

(54) CUP LID AND CUP

(71) Applicant: EVERICH AND TOMIC HOUSEWARES CO., LTD., Hangzhou (CN)

(72) Inventor: Huajun Yao, Hangzhou (CN)

(73) Assignee: EVERICH AND TOMIC HOUSEWARES CO., LTD., Hangzhou (CN)

( * ) Notice: Subject to any disclaimer, the term of this patent is extended or adjusted under 35 U.S.C. 154(b) by 0 days.

(21) Appl. No.: 19/084,447

(22) Filed: Mar. 19, 2025

(65) Prior Publication Data

US 2025/0313387 A1 Oct. 9, 2025

(30) Foreign Application Priority Data

Apr. 9, 2024 (CN) ..... 202420727970.0

(51) Int. Cl.
*B65D 47/30* (2006.01)
*A47G 19/22* (2006.01)
*B65D 47/32* (2006.01)

(52) U.S. Cl.
CPC ..... *B65D 47/30* (2013.01); *A47G 19/2272* (2013.01); *B65D 47/32* (2013.01)

(58) Field of Classification Search
CPC .... B65D 47/30; B65D 47/32; A47G 19/2272; A47G 19/2266
See application file for complete search history.

(56) References Cited

U.S. PATENT DOCUMENTS 2,615,607 A * 10/1952 Huskey ..... B65D 47/30 222/479
4,946,079 A * 8/1990 Campbell ..... B67D 3/048 222/548
2018/0215516 A1* 8/2018 Hershberger ..... B67D 7/005

* cited by examiner

*Primary Examiner* — James N Smalley
(74) *Attorney, Agent, or Firm* — Westbridge IP LLC

(57) ABSTRACT

Discloses are a cup lid and a cup. The cup lid includes a lid body. The lid body has a mounting chamber, the mounting chamber is detachably provided with an elastic mounting base. The mounting base has a first channel and the mounting base is provided with a switch component. The switch component includes a ball-nose and an operation portion. The ball-nose is configured to divide the first channel into an upper channel and a lower channel, and the ball-nose has a second channel. The mounting base is elastic and the mounting base can form a good sealing fit with the ball-nose of the switch component.

9 Claims, 7 Drawing Sheets

CUP LID AND CUP

CROSS-REFERENCE TO RELATED APPLICATIONS

This application claims priority to Chinese Patent Application No. 202420727970.0, filed on Apr. 9, 2024, which is hereby incorporated by reference in its entirety.

TECHNICAL FIELD

The present application relates to the technical field of cups, and in particular to a cup lid and a cup.

BACKGROUND

In the related art, a water cup includes a lid body, a sealing cover, and a spout. A top surface of the lid body has a spherical groove. The spout is located at the opening of the spherical groove, and a bottom surface at the end has a ball-nose. After the ball-nose is inserted into the spherical groove, its corresponding side walls are respectively hinged to the corresponding side walls of the spherical groove via pins. A bottom of the spherical groove has a water-suction hole connected to the inner cavity of the lid body. The interior of the spout has a water-suction channel communicated with the water-suction hole. One end of the sealing cover is hinged at the opening edge of the spherical groove. After the sealing cover is closed, the other end of the sealing cover can be detachably buckled to the side wall of the lid body. The sealing cover covers and wraps the water-drinking port. However, the spout of this cup lid is difficult to replace, which is not conducive to hygiene in the long run.

SUMMARY

The present application provides a cup lip and a cup in view of the problems existing in the prior art, aiming to overcome the defect that the suction nozzle of the existing cup cover with a ball-nose is inconvenient to replace.

The present application provides a cup lid, including a lid body; and a mounting chamber provided at the lid body, the mounting chamber is detachably provided with an elastic mounting base, the mounting base has a first channel, the mounting base is provided with a switch component, the switch component includes a ball-nose rotatably embedded into the mounting base and an operation portion located outside the mounting base; the ball-nose is configured to divide the first channel into an upper channel and a lower channel, the ball-nose has a second channel, the switch component has an open position and a closed position; when the switch component is in the open position, the second channel communicates the upper channel with the lower channel; and when the switch component is in the closed position, the ball-nose disconnects the upper channel and the lower channel, and the mounting base is provided with a suction pipe.

In an embodiment, a bottom of the mounting chamber has a mounting hole penetrating downward, the mounting base includes a plug-in portion inserted into the mounting hole, and the suction pipe includes a suction nozzle integrally formed on the mounting base and an inner pipe body inserted into the plug-in portion.

In an embodiment, the lid body has a mounting groove, the operation portion is connected to the ball-nose via a connecting column, the connecting column is embedded in the mounting groove, and the operation portion protrudes from an upper surface of the lid body.

In an embodiment, the lid body has a closed operation groove, when the switch component is in the open position, a closing operation surface on the operation portion is tilted towards the closed operation groove.

In an embodiment, the lid body is provided with a first air return hole, the mounting base is provided with a second air return hole, the switch component is provided with a third air return hole, when the switch component is in the open position, the first air return hole, the second air return hole and the third air return hole are communicated, and when the switch component is in the closed position, the second air return hole and the third air return hole are disconnected.

In an embodiment, a diameter of the ball-nose is greater than a diameter of the connecting column, and an inner wall of the mounting base is in contact with the switch component.

In an embodiment, the mounting base is fixedly connected to an inner wall of the mounting chamber with an interference fit.

In an embodiment, the suction pipe is an integral structure, and when the switch component is in the open position, the suction pipe passes through the first channel and the second channel.

The present application further provides a cup, including: a cup body; and the cup lid as described above, the lid body is removably fixed on the cup body, and the suction pipe of the cup lid is inserted into the cup body.

The present application provides a cup lid and a cup, the mounting base is elastic and the mounting base can form a good sealing fit with the ball head of the switch component. The cup can be opened and closed conveniently by rotating the switch component. The suction pipe is provided at the mounting base, and the suction pipe can be disassembled together with the mounting base or independently of the mounting base, so that the suction pipe can be easily cleaned or replaced, which is conducive to maintaining hygiene.

DETAILED DESCRIPTION OF THE EMBODIMENTS

Figure 1:
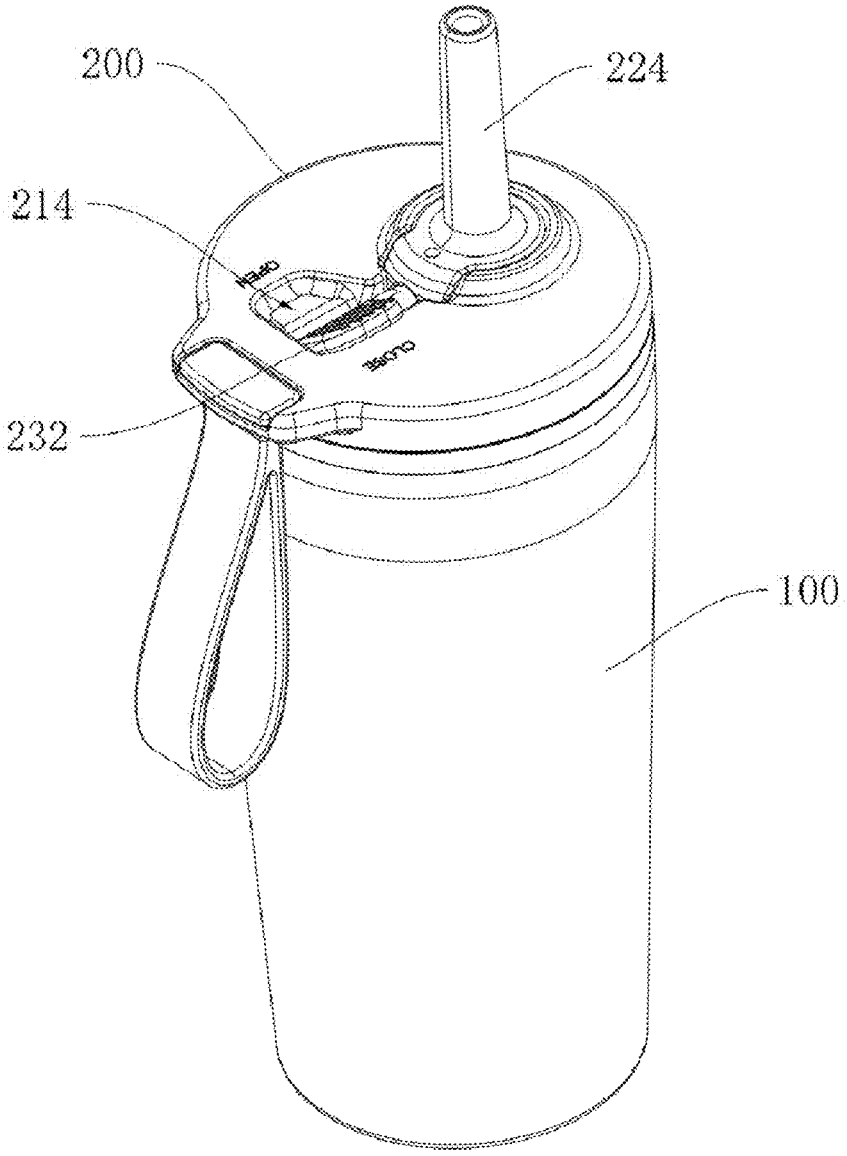
FIG. 1 is a schematic structural view of a cup according to an embodiment of the present application.

The following is a detailed description of the specific implementation method of the present application with reference to the accompanying drawings of the embodiments, so as to make the technical solution of the present application easier to understand and master. It should be understood that the specific embodiments described here are only for explaining the present application and not for limiting the present application.

The present application provides a cup, as shown in FIG. 1 to FIG. 5, including a cup body 100 and a cup lid 200. A lid body 210 is removably fixed on the cup body 100. The cup lid 200 includes the lid body 210, and a mounting chamber 211 is provided at the lid body 210. The mounting chamber 211 is detachably provided with an elastic mounting base 220, which can be made of silicone. The switch component 230 can be made of plastic or stainless steel.

Figure 2:
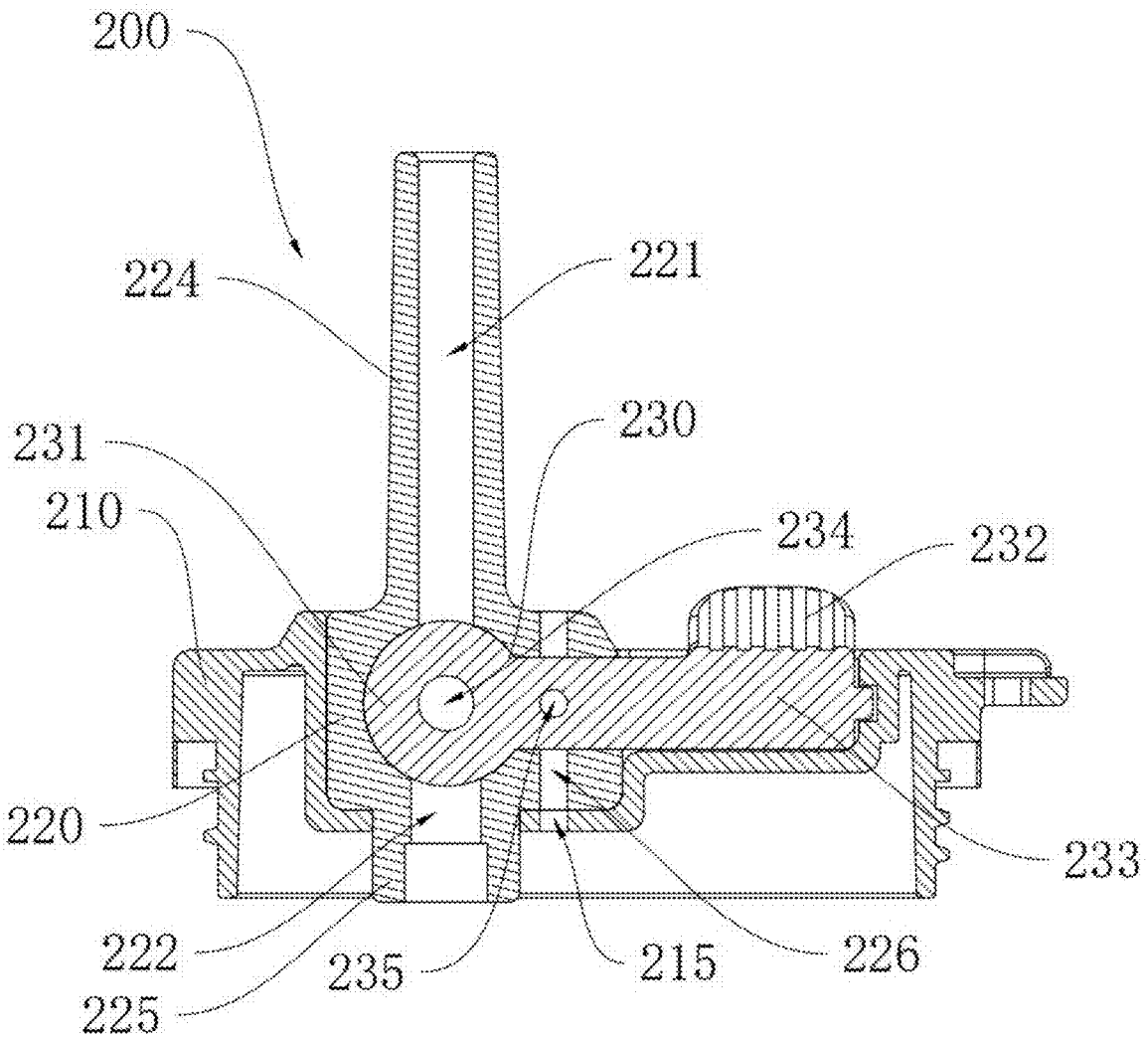
FIG. 2 is a schematic cross-sectional structural view of a cup lid when the switch member is in the closed position according to an embodiment of the present application.
Figure 4:
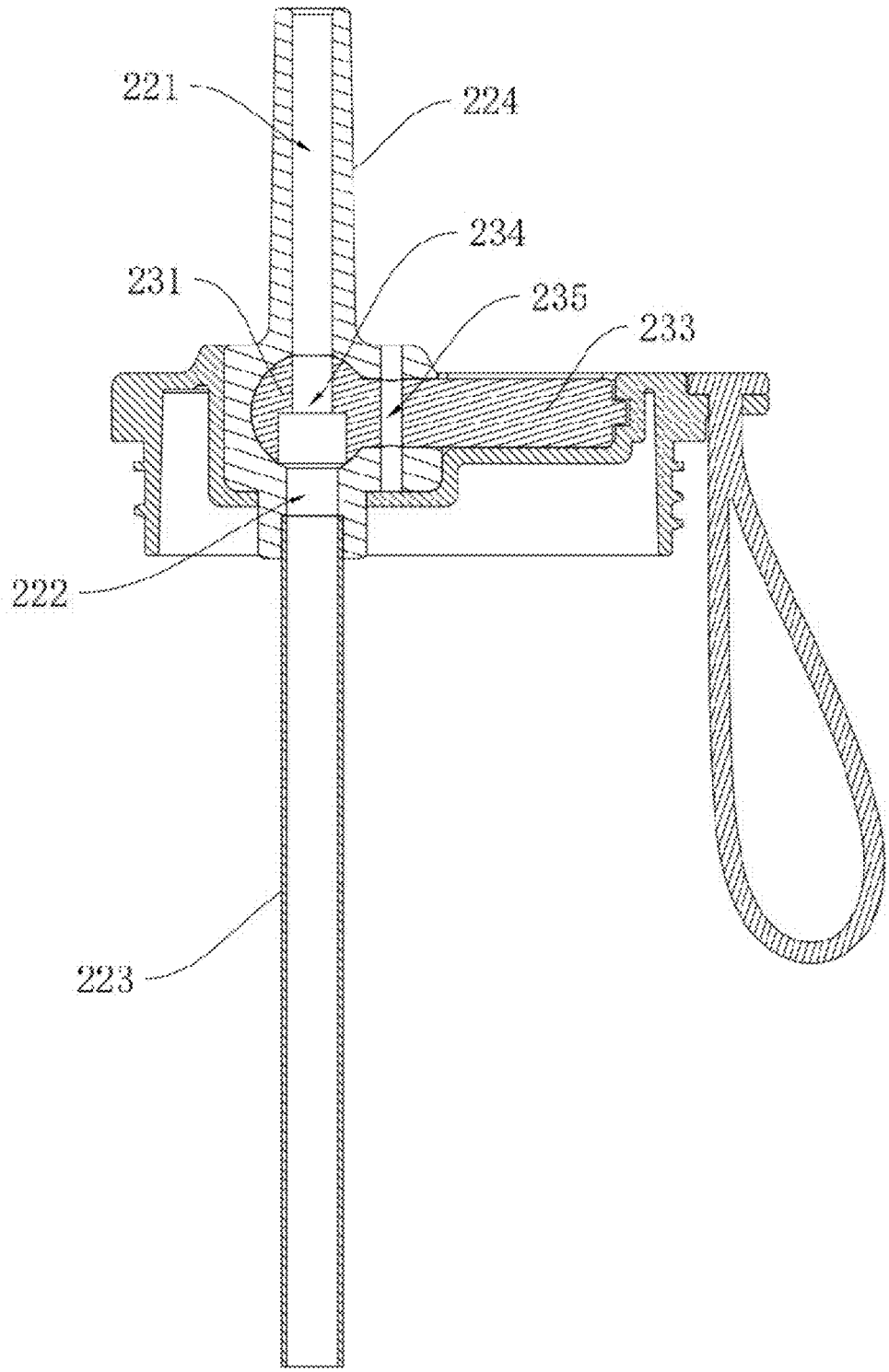
FIG. 4 is a schematic cross-sectional structural view of a cup lid when the switch member is in the open position according to an embodiment of the present application.

As shown in FIG. 2 and FIG. 4, the mounting base 220 has a first channel, and the mounting base 220 is provided with a switch component 230. The switch component 230 includes a ball-nose 231 rotatably embedded into the mounting base 220 and an operation portion 232 located outside the mounting base 220. The mounting base 220 is elastic, the mounting base can form a good sealing fit with the ball-nose 231 of the switch component 230 and allow the switch component 230 to rotate relative to the mounting base 220. The ball-nose 231 is configured to divide the first channel into an upper channel 221 and a lower channel 222, and the ball-nose 231 has a second channel 234. The switch component 230 has an open position and a closed position. As shown in FIG. 4, when the switch component 230 is in the open position, the second channel 234 communicates the upper channel 221 with the lower channel 222. As shown in FIG. 2, when the switch component 230 is in the closed position, the ball-nose 231 disconnects the upper channel 221 and the lower channel 222.

The mounting base 220 is provided with a suction pipe 240, and a bottom of the mounting chamber 211 has a mounting hole 212 penetrating downward. The mounting base 220 includes a plug-in portion 225 inserted into the mounting hole 212. The suction pipe 240 includes a suction nozzle 224 integrally formed on the mounting base 220 and an inner pipe body 223 inserted into the plug-in portion 225. When the switch component 230 is in the open position, the user can drink the liquid in the cup body by biting the suction nozzle 224. Since the suction nozzle 224 comes into direct contact with the mouth, it is prone to bacterial growth. The elastic mounting base 220 forms an interference fit with the lid body 210, allowing for easy disassembly and cleaning or replacement of the suction nozzle, which helps maintain its hygiene. When replacing the mounting base 220, the mounting base 220 and the switch component 230 are removed together, then separated. The switch component 230 can be reused, reducing replacement costs.

The elastic mounting base 220 can form a stable fit with the inner pipe body 223, eliminating the need for additional parts for the inner pipe body to fit with the lid body 210 and simplifying the structure of the cup lid 200. The inner pipe body is inserted into the cup body 100 and connected to the suction nozzle through the first channel and the second channel.

Figure 5:
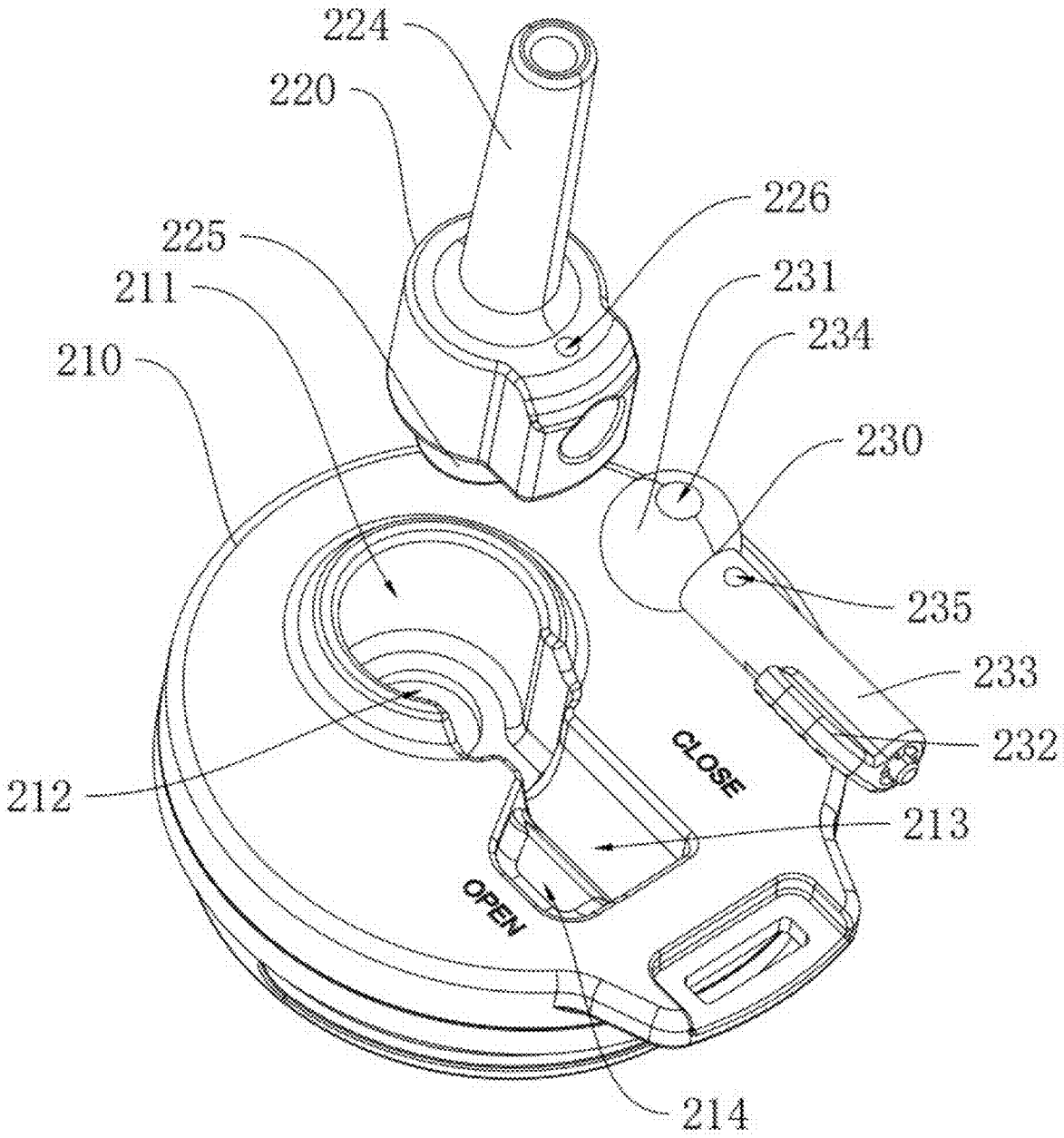
FIG. 5 is a schematic exploded structural view of a cup lid according to an embodiment of the present application.

As shown in FIG. 2, FIG. 4, and FIG. 5, an outer contour of the mounting base 220 is larger than an outer diameter of the suction nozzle 224. This larger mounting base 220 better secures the ball-nose 231, allowing for a larger ball-nose size and thus a larger second channel 234, improving drinking smoothness. The diameter of the ball-nose 231 is greater than that of the connecting column 233, and the inner wall of the mounting base 220 is in contact with the switch component 230.

As shown in FIG. 2, the lid body 210 has a mounting groove 213. The operation portion 232 is connected to the ball-nose 231 via a connecting column 233, the connecting column 233 is embedded in the mounting groove 213. The operation portion 232 protrudes from the upper surface of the lid body 210, preventing the connecting column 233 from protruding from the upper surface of the lid body 210.

Figure 3:
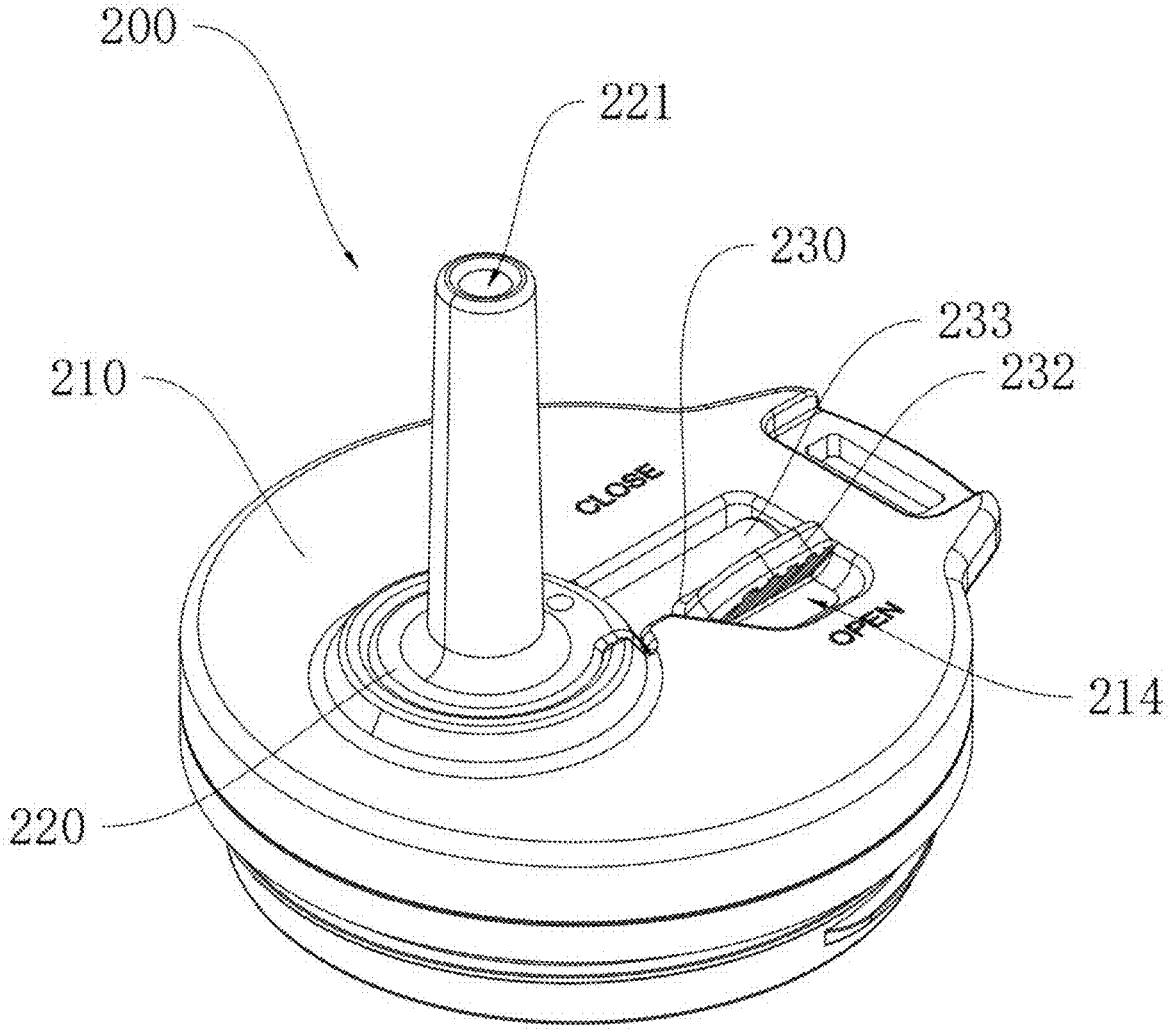
FIG. 3 is a schematic structural view of a cup lid when the switch member is in the open position according to an embodiment of the present application.

As shown in FIG. 3, the lid body 210 has a closed operation groove 214. When the switch component 230 is in the open position, a closing operation surface on the operation portion 232 is tilted towards the closed operation groove 214. When closing the cup, the finger can make better contact with the closing operation surface, facilitating the closing operation. When the switch component 230 is in the closed position (as shown in FIG. 1 and FIG. 2), there is no corresponding groove at the corresponding position, reducing the risk of accidental opening and leakage.

The lid body 210 is provided with a first air return hole 215, the mounting base 220 is provided with a second air return hole 226, and the switch component 230 is provided with a third air return hole 235. When the switch component 230 is in the open position, the first air return hole 215, the second air return hole 226, and the third air return hole 235 are communicated. When the switch component 230 is in the closed position, the second air return hole 226 and the third air return hole 235 are disconnected.

In an embodiment, the suction pipe 240 includes separate suction nozzle and inner pipe body parts. In this embodiment, the suction pipe 240 is an integral structure.

Figure 6:
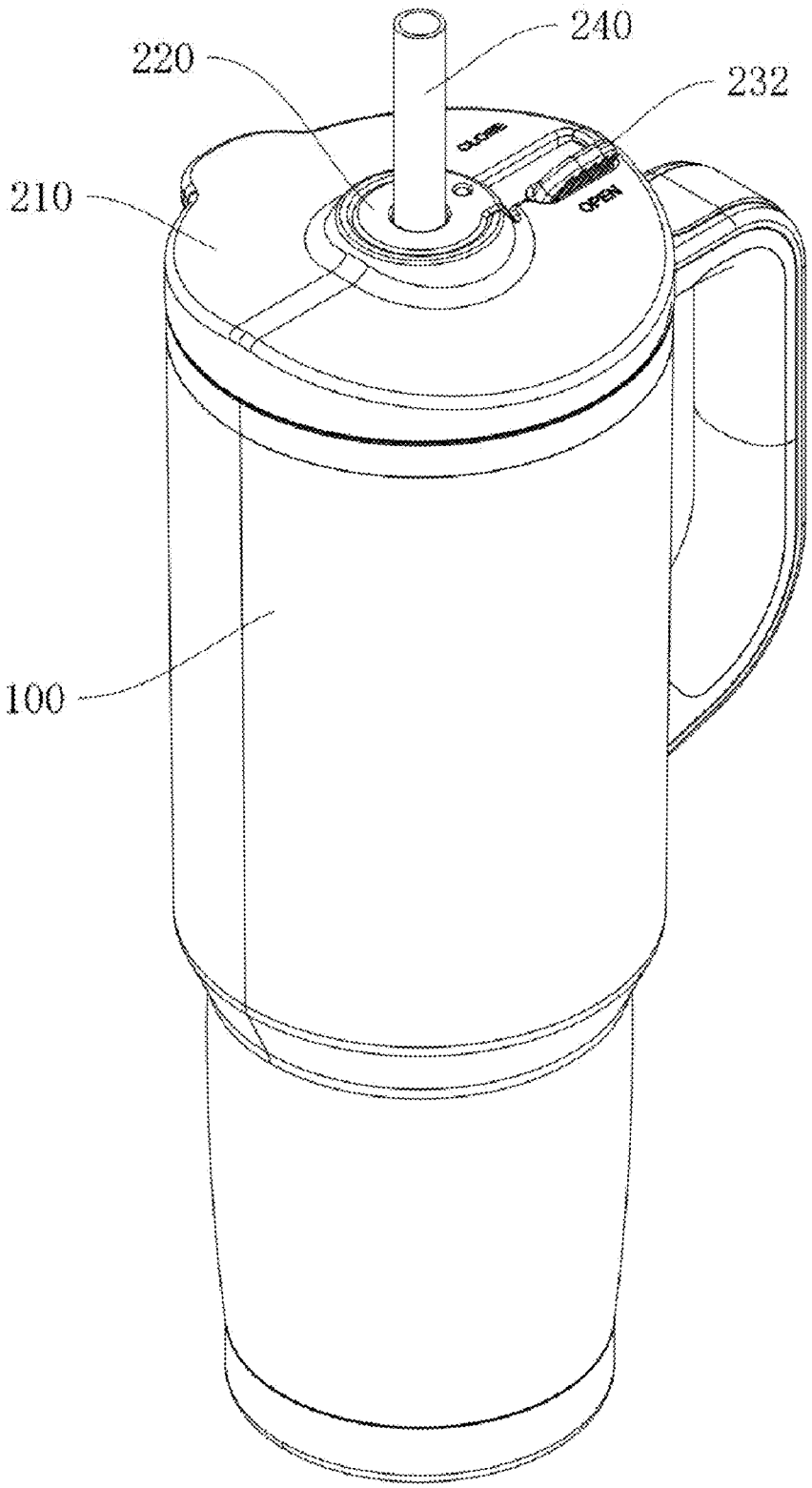
FIG. 6 is a schematic structural view of a cup according to another embodiment of the present application.
Figure 7:
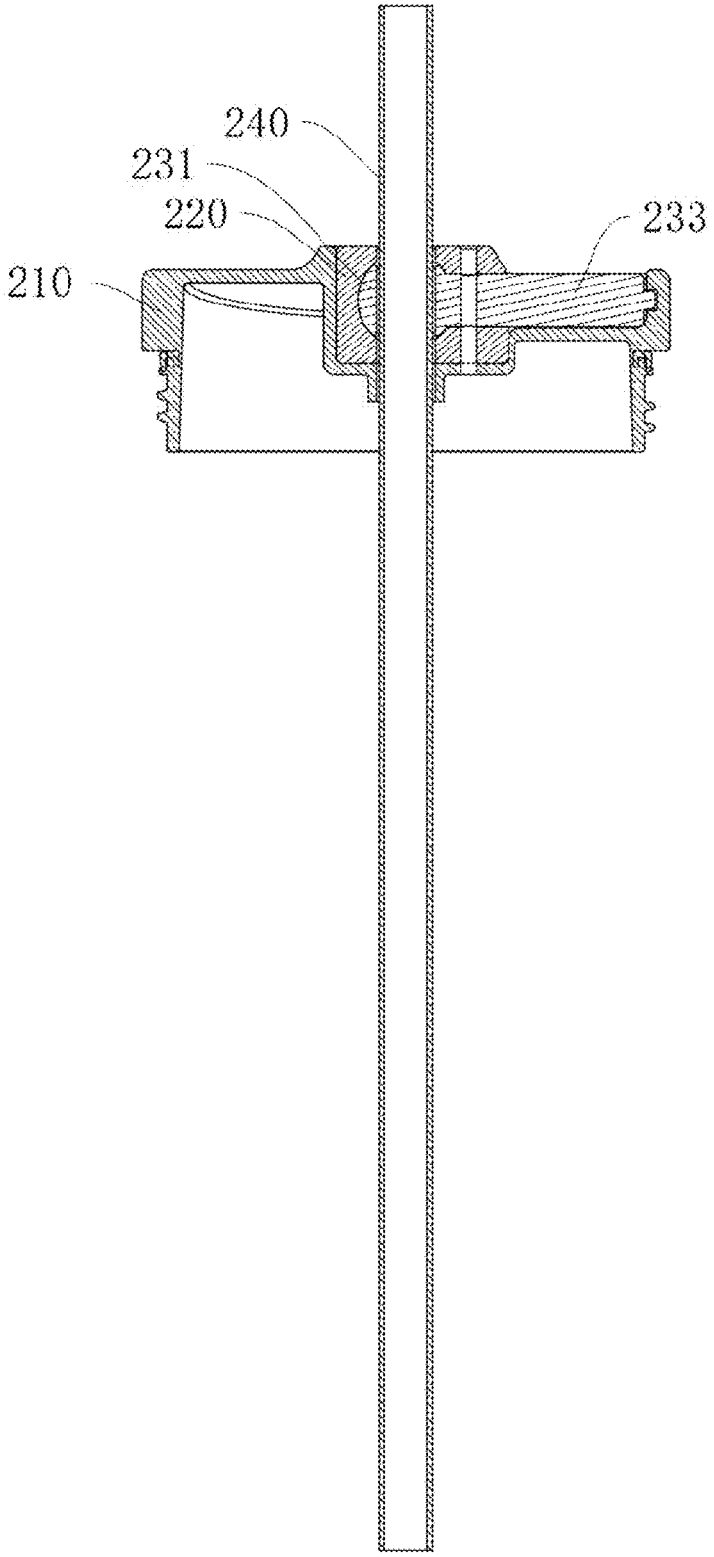
FIG. 7 is a schematic cross-sectional structural view of a cup lid when the switch member is in the open position according to another embodiment of the present application.

In an embodiment, as shown in FIG. 6 and FIG. 7, when the switch component is in the open position, the suction pipe 240 passes through the first channel and the second channel. The upper end of the suction pipe 240 protrudes from the mounting base 220, and the lower end is inserted into the cup body 100. To close the cup, pull out the suction pipe 240 and rotate the switch component to the closed position. The suction pipe 240 can be independently disassembled and replaced from the mounting base, allowing it to be replaced with a conventional, more universal suction pipe 240, reducing replacement costs and ensuring cup hygiene.

The above are only some embodiments of the present application, and do not limit the scope of the present application thereto. Under the concept of the present application, equivalent structural transformations made according to the description and drawings of the present application, or direct/indirect application in other related technical fields are included in the scope of the present application.

What is claimed is:

1. A cup lid, comprising:

a lid body; and a mounting chamber provided at the lid body, wherein:

an elastic mounting base is detachably connected to the mounting chamber, the elastic mounting base has a first channel, the elastic mounting base is provided with a switch component, the switch component comprises a ball-nose rotatably embedded into the elastic mounting base and an operation portion located outside the elastic mounting base;

the ball-nose is configured to divide the first channel into an upper channel and a lower channel, the ball-nose has a second channel, the switch component has an open position and a closed position;

when the switch component is in the open position, the second channel communicates the upper channel with the lower channel; and when the switch component is in the closed position, the ball-nose disconnects the upper channel and the lower channel, and the elastic mounting base is provided with a suction pipe.

2. The cup lid according to claim 1, wherein a bottom of the mounting chamber has a mounting hole penetrating downward, the elastic mounting base comprises a plug-in portion inserted into the mounting hole, and the suction pipe comprises a suction nozzle integrally formed on the elastic mounting base and an inner pipe body inserted into the plug-in portion.

3. The cup lid according to claim 1, wherein the lid body has a mounting groove, the operation portion is connected to the ball-nose via a connecting column, the connecting column is embedded in the mounting groove, and the operation portion protrudes from an upper surface of the lid body.

4. The cup lid according to claim 1, wherein the lid body has a closed operation groove, when the switch component is in the open position, a closing operation surface on the operation portion is tilted towards the closed operation groove.

5. The cup lid according to claim 1, wherein:

the lid body is provided with a first air return hole, the elastic mounting base is provided with a second air return hole, the switch component is provided with a third air return hole, when the switch component is in the open position, the first air return hole, the second air return hole and the third air return hole are communicated, and when the switch component is in the closed position, the second air return hole and the third air return hole are disconnected.

6. The cup lid according to claim 3, wherein a diameter of the ball-nose is greater than a diameter of the connecting column, and an inner wall of the elastic mounting base is in contact with the switch component.

7. The cup lid according to claim 1, wherein the elastic mounting base is fixedly connected to an inner wall of the mounting chamber with an interference fit.

8. The cup lid according to claim 1, wherein the suction pipe is an integral structure, and when the switch component is in the open position, the suction pipe passes through the first channel and the second channel.

9. A cup, comprising:

a cup body; and the cup lid according to claim 1, wherein the lid body is removably fixed on the cup body, and the suction pipe of the cup lid is inserted into the cup body.

* * * * *